United States Patent [19]

D'Onofrio

[11] Patent Number: 4,630,166

[45] Date of Patent: Dec. 16, 1986

[54] A.C. POWER CONTROL FOR D.C. SOLENOID ACTUATORS

[75] Inventor: Anthony D'Onofrio, West Hartford, Conn.

[73] Assignee: Honeywell Inc., Minneapolis, Minn.

[21] Appl. No.: 791,171

[22] Filed: Oct. 17, 1985

[51] Int. Cl.[4] ..... H01H 47/32

[52] U.S. Cl. ..... 361/205; 361/210

[58] Field of Search ..... 361/205, 210

[56] References Cited

U.S. PATENT DOCUMENTS

| | | | |
|---|---|---|---|
| 3,689,808 | 9/1972 | Stampfle | 361/205 X |
| 3,699,399 | 10/1972 | Barber | 361/205 X |
| 3,940,634 | 2/1976 | Grogan | 361/205 X |
| 4,517,620 | 5/1985 | Boll | 361/205 X |

*Primary Examiner*—Michael L. Gellner

*Attorney, Agent, or Firm*—Mitchell J. Halista; Trevor B. Joike

[57] ABSTRACT

An A.C. power control circuit for a D.C. solenoid actuator which may be used for a solenoid operated valve uses a triac circuit to initially apply A.C. line voltage to energize the solenoid coil of the valve to be actuated to provide valve pull-in power. A capacitor in an RC network is concurrently charged to a D.C. level, and the D.C. voltage on the capacitor is used to control the gate of the triac. After a predetermined delay as determined by the RC network charging time of the capacitor, the triac is phase controlled to produce a change in the current applied to the solenoid coil. In one embodiment, the voltage applied to the solenoid coil changes at this time from the full sine wave voltage of the A.C. source to a voltage pulse which is only a portion of the positive half of the input sine wave. This voltage produces a change in the power applied to the solenoid coil to a hold-in power level. This circuit produces a current pulse phase control of up to 90°. In a second embodiment, a phase control of up to 180° can be achieved by using a full wave bridge circuit for rectifying the A.C. to supply D.C. power to a timing circuit operating in the base circuit of a transistor controlling the energization of a photo-triac. The output of the photo-triac is, in turn, used to control the "on" time of the power triac supplying the current to the solenoid coil.

16 Claims, 3 Drawing Figures

A.C. POWER CONTROL FOR D.C. SOLENOID ACTUATORS

BACKGROUND OF THE INVENTION

1. Field of the Invention

The present invention relates to solenoid actuators. More specifically, the present invention is directed to an A.C. power control circuit for direct current solenoid valves.

2. Description of the Prior Art

Alternating current (A.C.) operated solenoid valves have functional characteristics that make them acceptable for long stroke operation. This long stroke capability is a result of low open gap inductance which means low impedence and a high initial current. When the gap closes, the inductance increases to increase the impedence and produce a low holding current. This operation occurs automatically during the seating of the plunger. However, if for any reason the plunger does not seat and the gap remains open, then the solenoid coil current remains high and coil burnout is possible. On the other hand, the direct current (D.C.) operated solenoid requires large power for producing large strokes. However, when the plunger is seated, very little change is power occurs due to the lack of impendence change. However, the D.C. operated solenoid valve is free from the "buzz" problem associated with A.C. operated solenoid valve which requires shading rings to minimize the "buzz". Accordingly, it would be desirable to provide a valve having functional characteristics which incorporate the desirable features of the A.C. and D.C. operated solenoids, i.e., operation off an A.C. line without shading rings and no "buzz", large stroke capability and high current pull-in and low current hold in a package which must be cost effective and fit within conventional valve housings. One prior art approach was to use a diode in series with the solenoid coil to permit D.C. "half" wave operation from the A.C. line. In order to obtain the long stroke forces for large flow valves, the average power required would be quite high and without the A.C. type impedence change the holding power would be the same as the pull-in power. A subsequent device used a "full" wave bridge rectifier circuit. This had the advantage of eliminating the "buzz" and would require less input power because the average magnetic flux per cycle is higher. The major limitation with this approach is that the line common and the solenoid common cannot be the same which presents valve packaging problems because the valve body could not be connected to a common reference. Accordingly, it would be desirable to provide an A.C. power control circuit for operating a D.C. valve while eliminating the aforesaid limitations of the prior art circuits.

SUMMARY OF THE INVENTION

An object of the present invention is to provide an improved A.C. power circuit for operating a D.C. solenoid actuator.

In accomplishing this and other objects, there has been provided in accordance with the present invention, an A.C. circuit having a triac which is turned on to apply the line voltage for actuating the valve, a circuit for changing from full power to low power mode by applying a portion of the positive half of the input sine wave to the valve solenoid.

BRIEF DESCRIPTION OF THE DRAWINGS

A better understanding of the present invention may be had when the following detailed description is read in connection with the accompanying drawings in which.

DESCRIPTION OF THE PREFERRED EMBODIMENT

Figure 1:
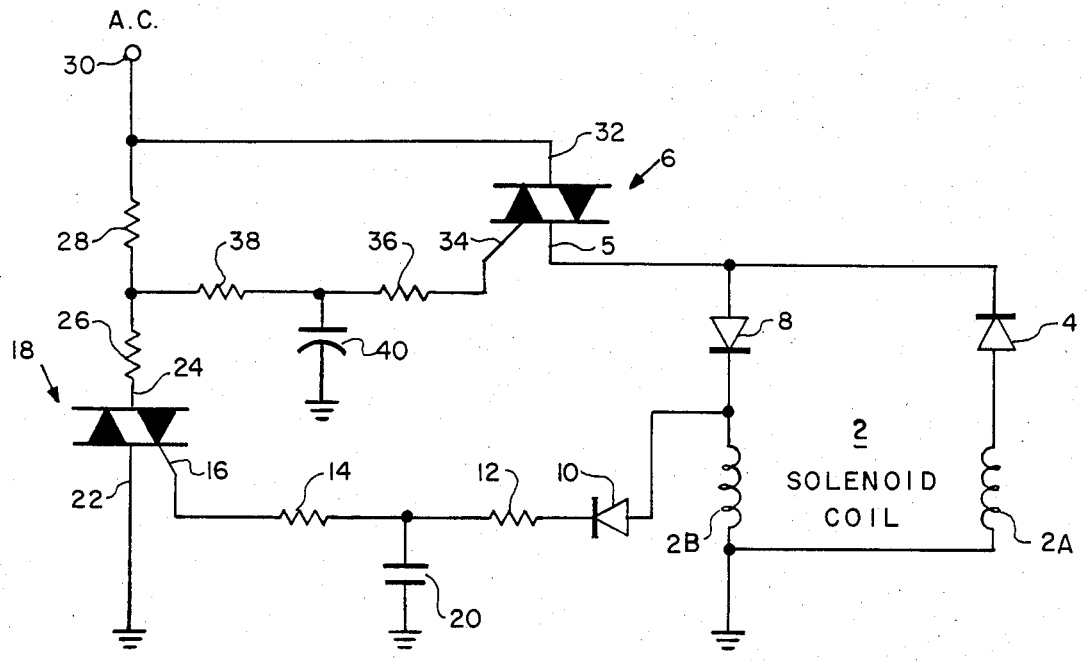
FIG. 1 is a schematic illustration of an example of a A.C. circuit used for operating a D.C. valve and embodying the present invention.

Referring to FIG. 1 in more detail, there is shown an A.C. power control circuit for operating a D.C. valve having a center tapped solenoid coil 2. The center tap of the coil 2 is connected to a common ground while the end of a first half 2A of the solenoid coil 2 is connected through a first diode 4 to the output electrode 5 of a first triac 6. The end of the other half 2B of the solenoid coil 2 is connected through an oppositely poled diode 8 to the same output electrode of the first triac 6. Additionally, the end of the second half 2B of the solenoid coil 2 is connected through a third diode 10 and a pair of series connected resistors 12 and 14 to the gate electrode 16 of a second triac 18. The junction between the first and second resistors 12 and 14 is connected by a first capacitor 20 to a common ground connection. An output electrode 22 of the second triac 18 is connected to a ground connection while the input electrode 24 of the second triac is connected through a pair of series connected resistors, i.e., third and fourth resistors 26 and 28, to an A.C. input terminal 30. The A.C. input terminal 30 is also connected to the input electrode 32 of the first triac 6. The gate electrode 34 of the first triac is connected through a pair of series connected resistors, i.e., fifth and sixth resistors 36 and 38, to the junction between the third and fourth resistors 26 and 28 while the junction between the fifth and sixth resistors 36 and 38 is connected by a second capacitor 40 to a common ground connection.

Figure 3:
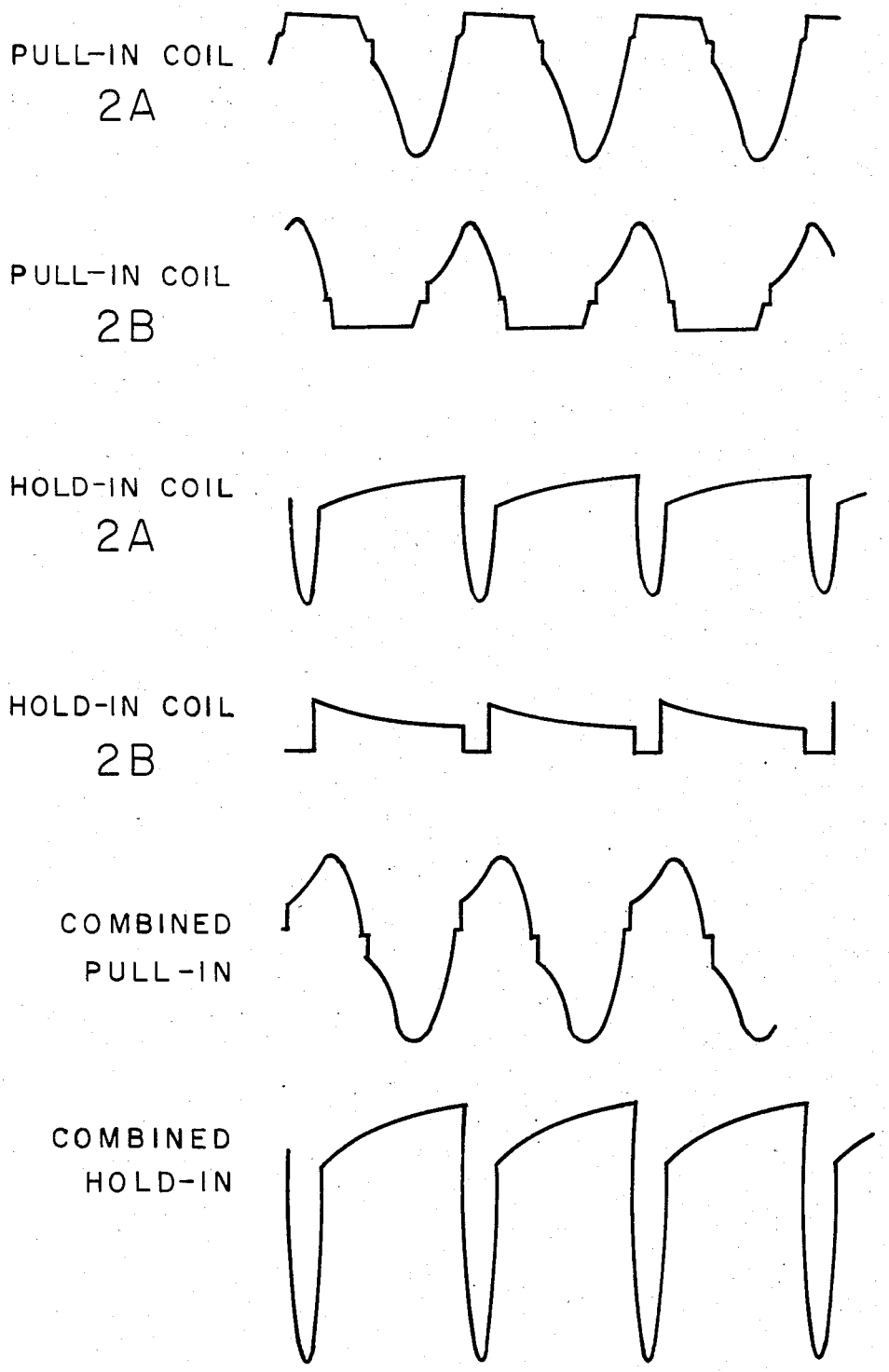
FIG. 3 is a waveshape diagram showing high and low current operation in the solenoid coils shown in FIGS. 2 and 3.

The first and second diodes 4,8 provide current paths for the positive and negative "half" waves of the A.C. signal to energize the halves of the solenoid coil to a common ground. As a result, the magnetic flux in the coil halves 2A, 2B is in the same direction to produce a magnetic flux which is the same as that which would be produced with a full wave bridge circuit and a single continuous coil circuit. The first triac is turned on as a result of the A.C. power applied through resistors 28, 38 and 36 to the gate electrode 34 of the first triac 6. When the first triac 6 is turned on, it applies the full A.C. line voltage from input terminal 30 to the diodes 4 and 8 to energize the solenoid coils to a common ground. Thus, the solenoid coils 2A,2B are each energized with a respective one of the A.C. half waves to produce a unidirectional magnetic flux to operate the solenoid valve. The circuit subsequently changes the current through the coils 2A,2B from a full power pull-in level to a low power hold-in level. This change is achieved by the components forming an RC timing network including the second diode 10, the first resistor 12, the second resistor 14, the third resistor 26 and the first capacitor 20 which are used to turn-on the second triac 18. Specifically, the first capacitor 20 will charge to a D.C. voltage level through the first diode 10 and the first resistor 12 after the A.C. power is applied to the second coil half 2B. The D.C. voltage level on the first capacitor 20 is applied through the second resistor R14 to the gate of the second triac 18. Thus, after a predetermined delay established by the R.C. network, the second triac 18 is turned "on" and connects one end of the third resistor 26 to ground. At this time, a phase shift will occur produced by the voltage division between the third resistor 26 and the fourth resistor 28. This phase shift is controllable by the value of the third resistor 26. The voltage at the input to the coil 2 from the triac 6 will consequently change from a full sine wave voltage to a voltage pulse which is only a portion of the positive half of each of the input sine waves. A waveshape diagram showing the aforesaid pull-in and hold-in currents for the solenoid coil 2 is illustrated in FIG. 3.

In this reduced power state, the solenoid valve plunger is assumed to be seated and only the hold-in power is required. A selection of the value of the third resistor 26 is used to selectively adjust this hold-in power for a particular solenoid valve. The operation of this circuit does not rely on plunger position feedback whereby the delay between switching from the high power mode to the low power mode in independent of the solenoid plunger position. If for some reason the plunger did not seat within the valve, the solenoid control circuit would still switch to the low power mode to prevent burn out of the solenoid coil 2. Thus, for large flow, long stroke valves, the pull-in power can be whatever is required and by selecting the value of the third resistor 26, the hold-in power can be selected to be compatible with whatever is required by a particular valve. Thus, the electronic circuit provides the advantages of both A.C. and D.C. solenoid operation whereby A.C. operation from an A.C. line is achieved without a shading ring on the valve while having a no "buzz" D.C. operation. The circuit provides all the characteristics of a "full" wave bridge D.C. operated circuit with the additional capability of high power "pull-in" and low power "hold-in" which is an A.C. solenoid characteristic brought about by the impedance change in A.C. operated solenoids between the opened and closed positions. As a result of the rapid change from the full pull-in power to the low current hold-in power, the circuit minimizes heating of the solenoid coil which may be reduced in size and powe requirements.

Figure 2:
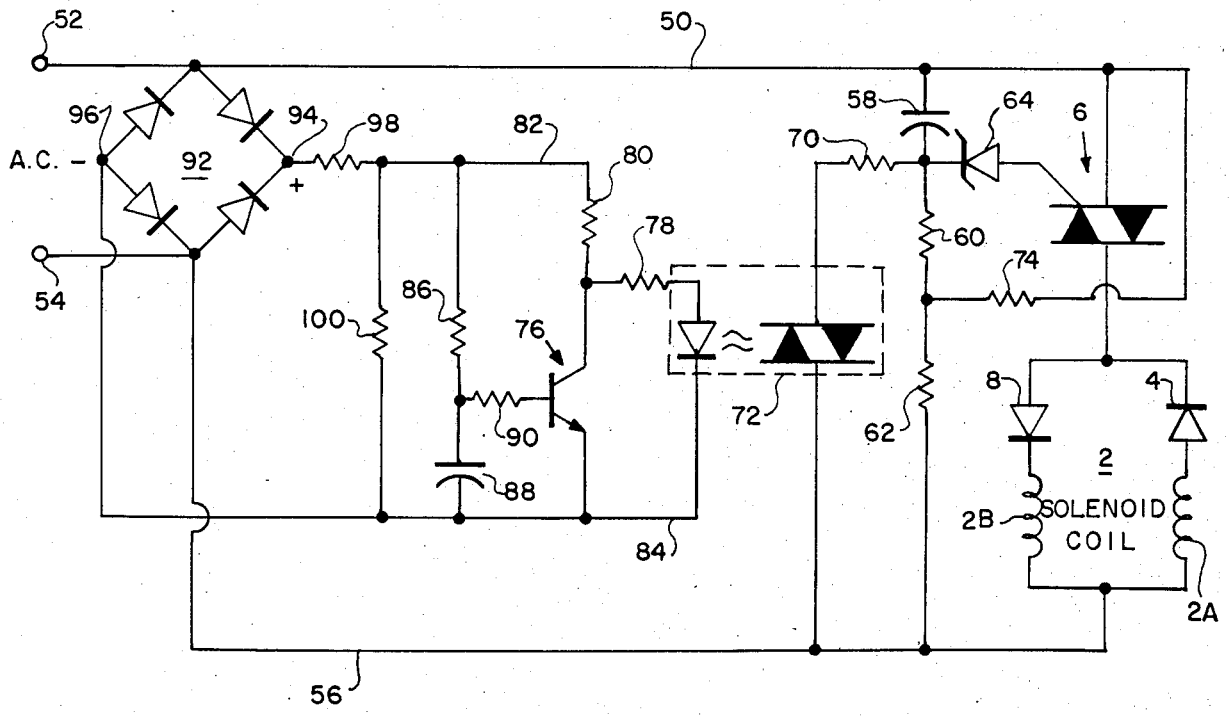
FIG. 2 is a schematic illustration of a modified A.C. circuit for operating a D.C. valve and also incorporating the present invention

A second embodiment of the A.C. power control circuit is shown in FIG. 2. This circuit has a full 180° phase angle control as well as dissipating less power in the control circuit. Similar reference numbers have been used in FIG. 2 to denote components similar to those described above with respect to FIG 1. Thus, the solenoid coil 2 is center-tapped with a first half coil 2A and a second half coil 2B. First and second diodes 4,8 are arranged to supply current paths to respective halves of the coil halves 2A,2B. The first and second diodes 4,8 are supplied with current from an electrode of a first triac 6. An input electrode for the first triac 6 is connected to an A.C. input line 50 connected to an A.C. input terminal 52. The second A.C. input terminal 54 is connected to a common ground line 56. A series connection of a first capacitor 58, a first resistor 60 and a second resistor 62 is connected between the first and second A.C. lines 50,56. A connection betwee the first capacitor 58 and the first resistor 60 is connected by a bilateral switch diode 64 providing a voltage reference to the gate electrode of the first triac 6. This connection is also connected through a third resistor 70 to an input electrode of a second triac 72 in the form of a photo-triac.

A connection between the first and second resistors 60,62 is connected by a fourth resistor 74 to the first A.C. line 50. An output electrode of the second triac 72 is connected to the second A.C. line 56. A photo-diode within the photo-triac 72 is connected across the collector and emitter electrodes of a first transistor 76 by a series resistor 78. The collector electrode of the transistor 76 is connected through a sixth resistor 80 to a D.C. supply line 82. The emitter of the first transistor 76 is connected to the negative D.C. supply line 84. A series connection of a seventh resistor 86 and a second capacitor 88 is connected between the positive and negative D.C. supply lines 82,84 while the junction between the resistor 86 and the capacitor 88 is connected through an eighth resistor 90 to the gate electrode of the transistor 76. A full-wave rectifier bridge 92 is connected between the A.C. supply lines 50,56 and is arranged to provide a D.C. output voltage at output terminals 94 and 96. A pair of series connected resistors 98 and 100 are connected across the output terminals 94,96 to provide a voltage division therebetween. The junction between the resistors 98,100 is connected to the positive D.C. supply line 82.

In operation, the circuit as shown in FIG. 2 performs the same functions as described for the circuit in FIG. 1 in providing a high pull-in current for the solenoid coils 2A,2B and, subsequently, switching to a lower hold-in current. However, by using a photo-triac 72 and a bilateral switch diode 64, a much larger range of a phase control can be realized with the range increasing from 90° to approximately 180° of phase control. In addition, by using the rectifier bridge 92 and a low power D.C. circuit, delays are obtainable without large electrolytic capacitors providing proved reliability as well as some cost saving and smaller package size. The delay between high and low power states is also more controllable due to the full-wave bridge 92 and the timing circuit operating in the base circuit of the transistor 76. Thus, the initial pull-in current is obtained from the full A.C. applied to the solenoid coil halves 2A,2B while the timing capacitor 88 in the base circuit of the transistor 76 is charging. When this timing capacitor 88 reaches a D.C. charge level, the transistor 76 is turned on to deenergize the photo-triac 72. The timing circuit is floating off the full-wave bridge rectifier 92 and is isolated by means of the photo-triac 72. The bilateral switch diode 64 provides a voltage reference for the gate of the first triac 6. Thus, the circuit operates to provide full wave A.C. power for pull-in and to switch after a time delay to apply a portion of each A.C. cycle to the coils 2A,2B to provide the lower hold-in power. In summary, full power is controlled by the resistor 70 and the triac 72. When the triac 72 is deenergized, the low power mode is controlled by resistor 60 and the divider voltage from resistors 62,74. It should be noted that when coil 2B is deenergized due to the negative going signal and the presence of diode 8, the voltage induced in the coil 2B during the current decrease will provide energy to drive the coil 2A through diodes 4 and 8, which are poled to pass the current from the negatively induced voltage. In a similar manner, the deenergization of coil 2A provides energy to drive coil 2B. Thus, the coils 2A,2B are always energized to a degree to eliminate any "buzz" of solenoid actuator.

The following is a detailed list of the circuit components used in a preferred construction of the illustrated example of the present invention as shown in FIGS. 1 and 2:

| | |
|---|---|
| Triac 6,18 (FIG. 1) | Type 5605 |
| Triac 6 (FIG. 2) | Type 2N6073A |
| Triac 72 | I.C. Type H11J3 |
| Diodes 4,8,10,92 | 1N4006 |
| Diode 64 | 2N6073A |
| Resistor 12 | 1.5K |
| Resistor 14,36 | 150 |
| Resistor 26 | 680 |
| Resistor 28,80 | 4.7K |
| Resistor 38 | 3.3K |
| Resistor 60 | 68.1K |
| Resistor 62 | 180K |
| Resistor 70 | 10K |
| Resistor 74,100 | 27K |
| Resistor 86 | 1.5 M |
| Resistor 90 | 100K |
| Resistor 98 | 15K |
| Capacitor 20 | 25 μfd |
| Capacitor 40 | .1 μfd |
| Capacitor 58 | .047 μfd |
| Capacitor 88 | .47 μfd |

Accordingly, it may be seen that there has been provided, in accordance with the present invention an improved A.C. power circuit for operating a D.C. solenoid actuator.

The embodiments of the present invention in which an exclusive property or privilege is claimed are defined as follows:

1. An A.C. power control circuit comprising
terminal means for connecting the control circuit to a source of A.C. power, and
circuit means for applying full-wave rectified A.C. power from said terminal means to a D.C. operated electromagnetic solenoid during an initial predetermined time period and including
means for reducing the phase angle of the rectified A.C. power to a less than 180° portion of each A.C. rectified wave after said initial full A.C. rectified wave application by said circuit means during said predetermined time interval.

2. A control circuit as set forth in claim 1 wherein said circuit means includes a current switch means and said means for reducing includes means for opening said switch means during a less than 180° portion of each A.C. wave following said time interval.

3. A control circuit as set forth in claim 2 wherein said current switch means includes a triac having a gate electrode and said means for reducing is connected to said gate electrode to control a current conduction of said triac.

4. A control circuit as set forth in claim 3 wherein said means for reducing includes an RC network having a capacitor storing a D.C. level for controlling the gate electrode of said triac.

5. A control circuit as set forth in claim 2 wherein said means for reducing includes a photo-triac having an output arranged to control the gate electrode of said triac.

6. A control circuit as set forth in claim 5 wherein said means for reducing includes an RC network control circuit arranged to control the energization of said photo-triac.

7. A control circuit as set forth in claim 6 wherein said means for reducing is arranged to be powered by said rectified A.C. power from said circuit means.

8. An A.C. power control circuit for a solenoid operated D.C. valve comprising
a D.C. solenoid for operating a valve,
terminal means for connecting the control circuit to a source of A.C. power,
circuit means for applying full-wave rectified A.C. power from said terminal means to said solenoid coil during a predetermined initial time period and including
means for reducing the phase angle of the rectified A.C. power to a less than 180° portion of each A.C. rectified wave after said initial full A.C. rectified wave application by said circuit means during said predetermined time interval.

9. A control circuit as set forth in claim 8 wherein said circuit means includes a current switch means and said means for reducing includes means for opening said switch means during a less than 180° portion of each A.C. wave following said time interval.

10. A control circuit as set forth in claim 9 wherein said current switch means includes a triac having a gate electrode and said means for reducing is connected to said gate electrode to control a current conduction of said triac.

11. A control circuit as set forth in claim 10 wherein said current switch means includes a triac having a gate electrode and said means for reducing is connected to said gate electrode to control a current conduction of said triac.

12. A control circuit as set forth in claim 9 wherein said mean for reducing includes a photo-triac having an output arranged to control the gate electrode of said triac.

13. A control circuit as set forth in claim 12 wherein said means for reducing includes a RC network control circuit arranged to control the energization of said photo-triac.

14. A control circuit as set forth in claim 13 wherein said means for reducing is arranged to be powered by said rectified A.C. power from said circuit means.

15. A method of supplying A.C. power to a D.C. operated electromagnetic solenoid actuator including the steps of rectifying the A.C. power, initially applying the full wave of the rectified A.C. power to the actuator and after a predetermined time interval reducing the phase angle of the rectified A.C. power to a less than 180° portion of each A.C. rectified wave.

16. A method of supplying A.C. power to a solenoid operated D.C. valve including the steps of rectifying the A.C. power, initially applying the full wave of the rectified A.C. power to the solenoid operator of the D.C. valve and after a predetermined time interval reducing the phase angle of the rectified A.C. power to a less than 180° portion of each A.C. rectified wave.

* * * * *